US007114972B1

(12) United States Patent
Riner

(10) Patent No.: US 7,114,972 B1
(45) Date of Patent: Oct. 3, 2006

(54) RETRO-FIT RECEPTACLE MOUNTING METHOD AND APPARATUS

(75) Inventor: Raymond H. Riner, Fort Wayne, IN (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 11/318,921

(22) Filed: Dec. 27, 2005

Related U.S. Application Data

(60) Provisional application No. 60/639,869, filed on Dec. 28, 2004.

(51) Int. Cl.
*H01R 4/60* (2006.01)

(52) U.S. Cl. ..... 439/215

(58) Field of Classification Search ..... 439/215, 439/209, 211, 216
See application file for complete search history.

(56) References Cited

U.S. PATENT DOCUMENTS 4,952,164 A * 8/1990 Weber et al. ..... 439/215
5,013,252 A * 5/1991 Nienhuis et al. ..... 439/215
5,092,786 A * 3/1992 Juhlin et al. ..... 439/215
5,092,787 A * 3/1992 Wise et al. ..... 439/215
5,096,431 A 3/1992 Byrne ..... 439/171
5,131,860 A * 7/1992 Bogiel ..... 439/215
5,164,544 A 11/1992 Snodgrass et al. ..... 174/48
5,178,555 A * 1/1993 Kilpatrick et al. ..... 439/215
5,186,640 A * 2/1993 McCoy ..... 439/211
5,203,711 A 4/1993 Bogiel ..... 139/215
5,203,712 A * 4/1993 Kilpatrick et al. ..... 439/215
5,252,086 A * 10/1993 Russell et al. ..... 439/215
5,349,135 A * 9/1994 Mollenkopf et al. ..... 174/497
5,503,565 A * 4/1996 McCoy ..... 439/171
5,562,469 A * 10/1996 Nienhuis et al. ..... 439/215
5,584,714 A * 12/1996 Karst et al. ..... 439/215
5,915,984 A * 6/1999 Rupert et al. ..... 439/215
5,941,720 A * 8/1999 Byrne ..... 439/215
6,027,352 A * 2/2000 Byrne ..... 439/215
6,036,516 A * 3/2000 Byrne ..... 439/215
6,036,517 A * 3/2000 Byrne ..... 439/215
6,186,825 B1 * 2/2001 Bogiel et al. ..... 439/532
6,478,602 B1 * 11/2002 Chapman et al. ..... 439/373
6,491,535 B1 * 12/2002 Buse ..... 439/215
6,575,777 B1 * 6/2003 Henriott et al. ..... 439/215
6,605,776 B1 * 8/2003 Laukhuf ..... 174/500
6,652,288 B1 11/2003 Laukhuf et al. ..... 439/32
6,652,303 B1 * 11/2003 Stockel et al. ..... 439/215
6,652,308 B1 * 11/2003 Chapman et al. ..... 439/373
6,835,081 B1 * 12/2004 Plattner et al. ..... 439/215
6,910,903 B1 * 6/2005 Kondas ..... 439/215
6,939,153 B1 * 9/2005 Kondas et al. ..... 439/211
6,991,485 B1 * 1/2006 Plattner et al. ..... 439/215
7,008,248 B1 * 3/2006 Kondas et al. ..... 439/211
7,008,249 B1 * 3/2006 McCoy et al. ..... 439/215

(Continued)

*Primary Examiner*—Ross Gushi
(74) *Attorney, Agent, or Firm*—Taylor & Aust, P.C.

(57) ABSTRACT

An electrical distribution assembly for use in a modular wall panel assembly, which includes an electrical harness with a conductor carrier with a first carrier side, a second carrier side and a plurality of conductors therein and a connector electrically connected to the plurality of conductors and the conductor carrier. The connector includes an electrical connector port, and a modular receptacle connected to the electrical connector port. A first bracket is positioned on the first carrier side and a second bracket is positioned on the second carrier side and directly connected to the first bracket. An add-on modular receptacle is mechanically connected to the first bracket or the second bracket.

20 Claims, 6 Drawing Sheets

U.S. PATENT DOCUMENTS

2002/0137381 A1* 9/2002 Chapman et al. ..... 439/215
2004/0053527 A1* 3/2004 Kondas ..... 439/215
2004/0102072 A1* 5/2004 Plattner et al. ..... 439/215
2005/0009393 A1* 1/2005 Kondas et al. ..... 439/215
2005/0095890 A1* 5/2005 Plattner et al. ..... 439/215
2006/0024996 A1* 2/2006 Johnson et al. ..... 439/215

* cited by examiner

RETRO-FIT RECEPTACLE MOUNTING METHOD AND APPARATUS

CROSS REFERENCE TO RELATED APPLICATIONS

This is a non-provisional application based upon U.S. provisional patent application Ser. No. 60/639,869, entitled "RETRO-FIT RECEPTACLE MOUNTING METHOD AND APPARATUS", filed Dec. 28, 2004.

BACKGROUND OF THE INVENTION

1. Field of the Invention

The present invention relates to electrical distribution assemblies within a modular wall panel assembly, and, more particularly, to a method and apparatus for retro-fitting another receptacle to an existing electrical distribution assembly.

2. Description of the Related Art

An electrified wall panel system is known where a power distribution server includes four receptacle ports which can have four corresponding power receptacles mounted thereto. The power distribution server is connected to a source of electrical power and, when a receptacle is connected to one of the receptacle ports, the receptacle is thereby connected to the source of electrical power. The electrified wall panel system is typically used to organize an office or industrial space into workstations where a worker may need to connect electrical equipment such as a computer, lights, electrical tools, other office equipment, etc., to a source of electrical power which can be conveniently accomplished by simply plugging the electrical equipment into a wall panel receptacle. The power distribution server includes a receptacle module retaining element which is riveted to a conductor channel of the power distribution server, and to which a receptacle is mounted to prevent the outward movement, or other movement, of the receptacle module retained in a respective port. Although this type of power distribution server is suitable for its intended purpose of connecting to four receptacles, there is no accommodation for adding additional receptacles in the field. For example, another receptacle module retaining element cannot be riveted to the conductor channel in the field as there are conductors existing in the channel which may be damaged by the riveting process. Further, even if the retaining element was safely riveted to the conductor channel, there is no additional electrical port on the power distribution server to which the additional receptacle can be connected.

An electrified space dividing panel is known which includes a modular electrical system with a terminal block which has first and second longitudinal ends, respectively, with the first end having first and second sockets of like construction, and with the second end having first and second sockets which are of the same construction as the first end sockets. Each of the sockets can be connected to a modular receptacle, or to a jumper cable. The terminal block also includes two lateral sockets which can connect to a different type of modular receptacle than which are connected to the end sockets of the terminal block. While this terminal block can theoretically connect to six modular receptacles, one of the end sockets must be use to bring power into the terminal block; therefore, realistically only five modular receptacles can be connected into the terminal block. A problem with this terminal block is that it requires two different types of modular receptacles. Another problem with this terminal block is that it is not easily adaptable to a power distribution server described above, or similar distribution unit, in order to retro-fit an add-on modular receptacle in the field. For example, the connector/socket types are different than the distribution unit which reduces the electrical compatibility with the modular electrical system, and the terminal block is bulky which reduces the mechanical compatibility with the modular electrical system and the electrified space dividing panel What is needed in the art is a method and apparatus for easily retro-fitting another receptacle to an existing electrical distribution assembly, which doesn't require different types of modular receptacles, and which is adaptable and can be easily integrated into the existing electrical distribution assembly and modular wall panel assembly.

SUMMARY OF THE INVENTION

The present invention provides method and apparatus for easily retrofitting an existing electrical distribution assembly with an add-on modular receptacle.

The invention comprises, in one form thereof, an electrical distribution assembly for use in a modular wall panel assembly, which includes an electrical harness with a conductor carrier which has a first carrier side, a second carrier side and a plurality of conductors therein and a connector electrically connected to the plurality of conductors and the conductor carrier. The connector includes an electrical connector port, and a modular receptacle connected to the electrical connector port. A first bracket is positioned on the first carrier side and a second bracket is positioned on the second carrier side and is directly connected to the first bracket. An add-on modular receptacle is mechanically connected to the first bracket or the second bracket.

The invention comprises, in another form thereof, a modular wall panel assembly which has a modular wall panel and an electrical distribution assembly connected to the modular wall panel. The electrical distribution assembly includes an electrical harness with a conductor carrier with a first carrier side, a second carrier side and a plurality of conductors therein and a connector electrically connected to the plurality of conductors and the conductor carrier. The connector includes an electrical connector port, and a modular receptacle connected to the electrical connector port. A first bracket is positioned on the first carrier side and a second bracket is positioned on the second carrier side and is directly connected to the first bracket. An add-on modular receptacle is mechanically connected to the first bracket or the second bracket.

The invention comprises, in another form thereof, a bracket assembly for adding an add-on modular receptacle to an electrical distribution assembly for use in a modular wall panel assembly. The electrical distribution assembly includes a conductor carrier with a first carrier side, a second carrier side, and a fixed modular receptacle bracket connected to one of the first carrier side and the second carrier side. The bracket assembly has a first bracket configured for positioning on the first carrier side; and a second bracket configured for positioning on the second carrier side and directly connected to the first bracket.

The invention comprises, in another form thereof, a method of adding an add-on modular receptacle to an electrical distribution assembly for use in a modular wall panel assembly, which includes the steps of: providing an electrical distribution assembly including an electrical harness having a conductor carrier with a first carrier side, a second carrier side and a plurality of conductors therein, a connector electrically connected to the plurality of conductors and the conductor carrier, the connector including an electrical connector port, and a modular receptacle connected to the electrical connector port; positioning a first bracket on the first carrier side; positioning a second bracket on the second carrier side; directly connecting the first bracket to the second bracket; and mechanically mounting an add-on modular receptacle to one of the first bracket and the second bracket.

An advantage of the present invention is that it can easily retro-fit an add-on modular receptacle to an existing electrical distribution assembly.

Another advantage of the present invention is that it only requires a single type of modular receptacle for both the existing receptacles and the add-on receptacles.

Yet another advantage of the present invention is that it does not require modification of the existing electrical harness.

Yet another advantage of the present invention is that it does not require additional wiring or circuits in the existing electrical distribution assembly.

Yet another advantage of the present invention is that it is easily integrated into the existing modular wall panel assembly.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
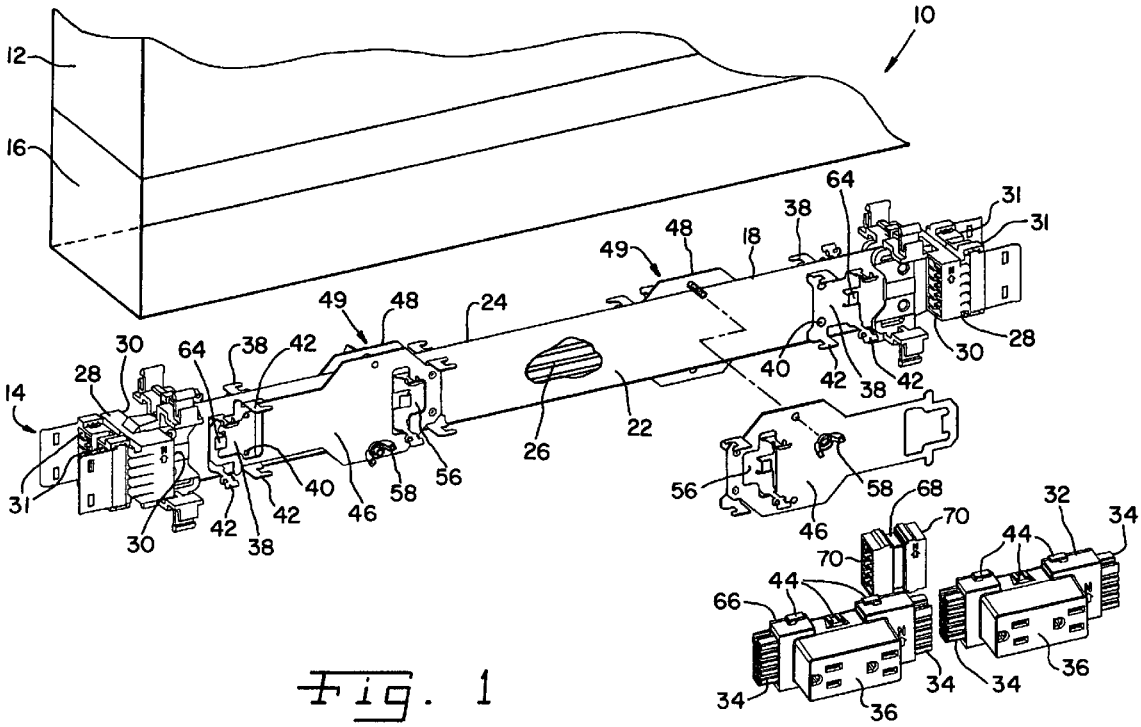
FIG. 1 is a perspective fragmentary exploded view of an embodiment of a modular wall panel assembly according to the present invention.
Figure 2:
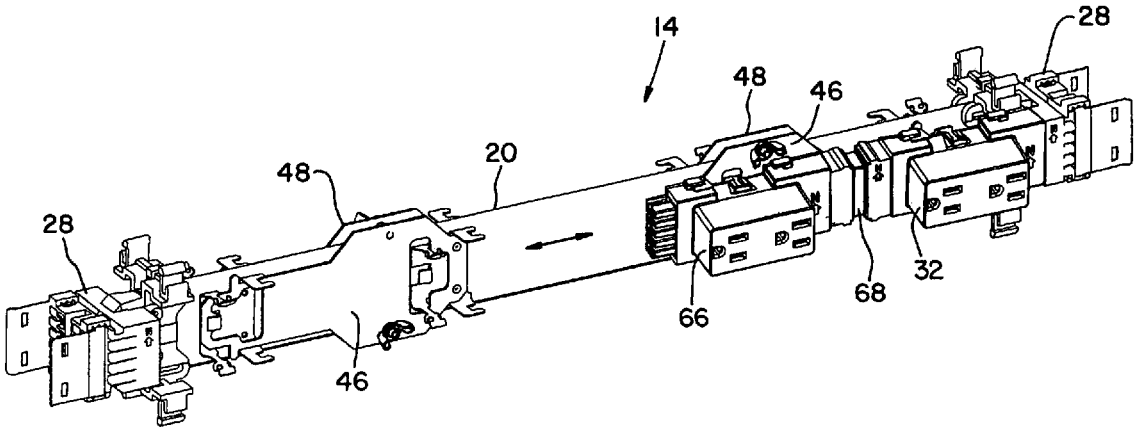
FIG. 2 is a perspective assembled view of the electrical distribution assembly of FIG. 1.

Referring now to the drawings, and more particularly to FIGS. 1 and 2, there is shown a modular wall panel assembly 10 which generally includes a modular wall panel 12 and an electrical distribution assembly 14 connected to modular wall panel 12. Electrical distribution assembly 14 may conveniently be installed in a base 16 of modular wall panel 12, although other locations within modular wall panel 12 are possible. Modular wall panel assembly 10 can include a base cover (not shown) which covers the majority of electrical distribution assembly 14 while still allowing access to the receptacle outlets.

Electrical distribution assembly 14 includes an electrical harness 18 with a conductor carrier 20 with a first carrier side 22, a second carrier side 24 and a plurality of conductors 26 therein. For example, there can be eight conductors 26, four line, two neutral and two ground. At least one connector 28 is electrically connected to conductors 26 and conductor carrier 20. Each connector 28 includes at least one electrical connector port 30, 31, and a modular receptacle 32 is typically connected to a respective electrical connector port 30 which is internally oriented. Each electrical connector port 30, 31 includes a plurality of electrical terminals which are electrically connected to respective ones of conductors 26. Electrical distribution assembly 14 is typically connected to a source of electrical power (not shown) at one of the externally oriented ports 31 through a jumper assembly or power infeed (also not shown). Modular receptacles 32 each can include a pair of receptacle connectors 34, where each receptacle connector 34 includes a plurality of electrical terminals connected to respective terminals in the other connector 34 of the connector pair, and also to respective receptacle outlets 36. By connecting a modular receptacle 32 to an electrical connector port 30, receptacle outlets 36 are electrically connected to respective conductors 26, and are therefore connected to a source of electrical power. In order to provide safe and secure mechanical connection of a modular receptacle 32 to electrical distribution assembly 14, a fixed modular receptacle bracket 38 is typically riveted 40 to electrical distribution assembly 14. Arms 42 of fixed modular receptacle bracket 38 mechanically connect to attachment elements 44 of a respective modular receptacle 32. Electrical distribution assembly 14 can have four modular receptacles 32 connected into respective ports 30.

Figure 3:
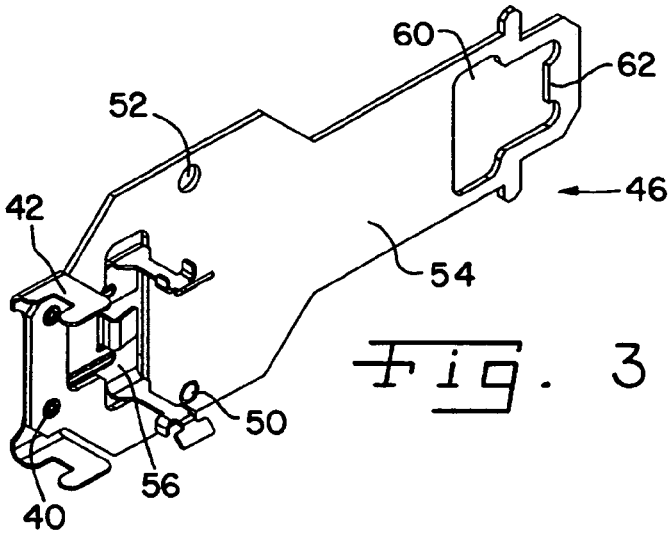
FIG. 3 is a perspective view of the first add-on bracket of FIGS. 1 and 2.
Figure 4:
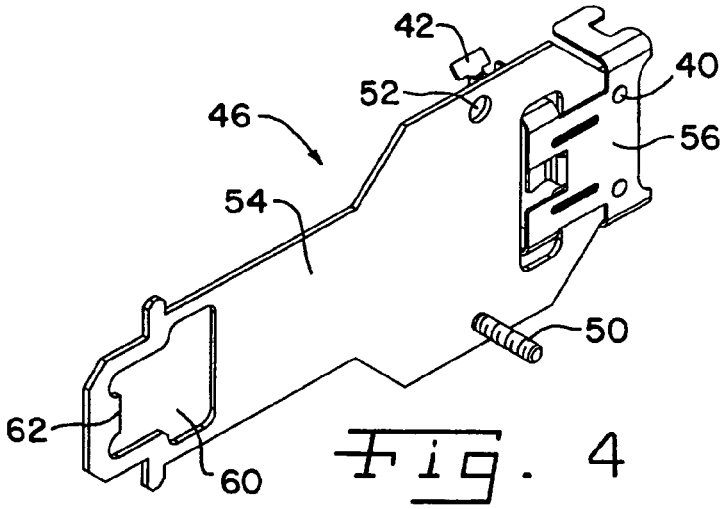
FIG. 4 is a perspective view of the opposite side of the first add-on bracket of FIG. 3.
Figure 5:
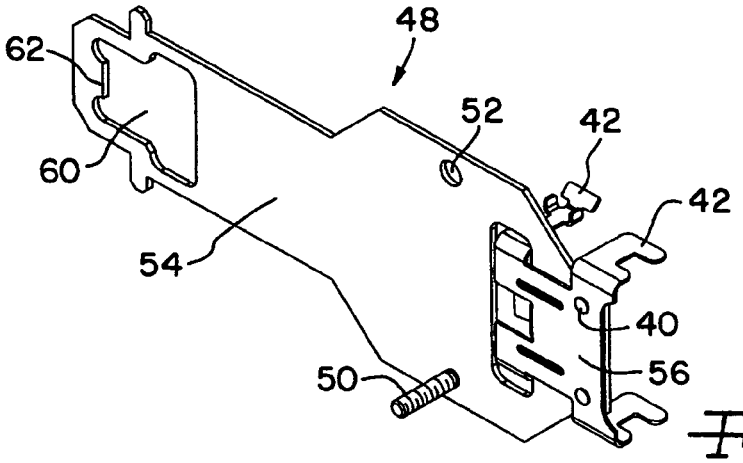
FIG. 5 is a perspective view of the second add-on bracket of FIGS. 1 and 2, and which mates with the first add-on bracket of FIGS. 3 and 4.

In order to retro-fit additional receptacles, electrical distribution assembly 14 further includes a first bracket 46 (FIGS. 3 and 4) positioned on first carrier side 22 and a second bracket 48 (FIG. 5) positioned on second carrier side 24 and directly connected to first bracket 46. Both first bracket 46 and second bracket 48 includes a threaded stud or fastener 50 and a stud hole 52 in plate 54. The main difference between first bracket 46 and second bracket 48 is that the position of threaded stud 50 and stud hole 52 are reversed. Each of first bracket 46 and second bracket 48 includes a receptacle bracket 56 connected thereto, and similar to brackets 38. Two wing nuts or fasteners 58 can be used to directly connect first bracket 46 to second bracket 48, by threading nuts 58 onto respective studs 50, and to clamp first bracket 46 and second bracket 48 to conductor carrier 20. Each plate 54 includes an aperture 60 with a tongue 62 extending therein. Fixed modular receptacle bracket 38 includes a tab 64 extending outward from conductor carrier 20, and tongue 62 can be inserted between tab 64 and conductor carrier 20 to directly connect at least one of brackets 46, 48 to fixed modular receptacle bracket 38. When so connected, fixed modular receptacle bracket 38 restricts movement of a respective bracket 46, 48 in a longitudinal direction of conductor carrier 20. Brackets 46, 48 comprise a bracket assembly 49, which can also include fasteners 58.

An add-on modular receptacle 66 can be mechanically connected to either first bracket 46 or second bracket 48. Add-on modular receptacle 66 is similar to, or the same as, electrical receptacle 32 in that it includes a pair of receptacle connectors 34, where each receptacle connector 34 includes a plurality of electrical terminals connected to respective terminals in the other connector 34 of the connector pair, and also to respective receptacle outlets 36. Add-on modular receptacle 66 also includes attachment elements 44. An electrical coupler 68 is electrically connected (FIG. 2) to modular receptacle 32 and add-on modular receptacle 66. Electrical coupler 68 includes electrical ports 70 which each have a plurality of electrical terminals which are respectively interconnected between the ports 70, so that when: electrical distribution assembly 14 is connected to a source of electrical power, modular receptacle 32 is connected to a connector port 30, electrical coupler 68 is connected to modular receptacle 32 and add-on modular receptacle 66 is connected to electrical coupler 68, add-on modular receptacle 66 is thereby connected to the source of electrical power and electrified. Consequently, if two bracket assemblies 49 are used, electrical distribution assembly 14 can now include four modular receptacles 32 and four add-on modular receptacles 66, where add-on modular receptacles 66 can be easily field retro-fitted.

Figure 6:
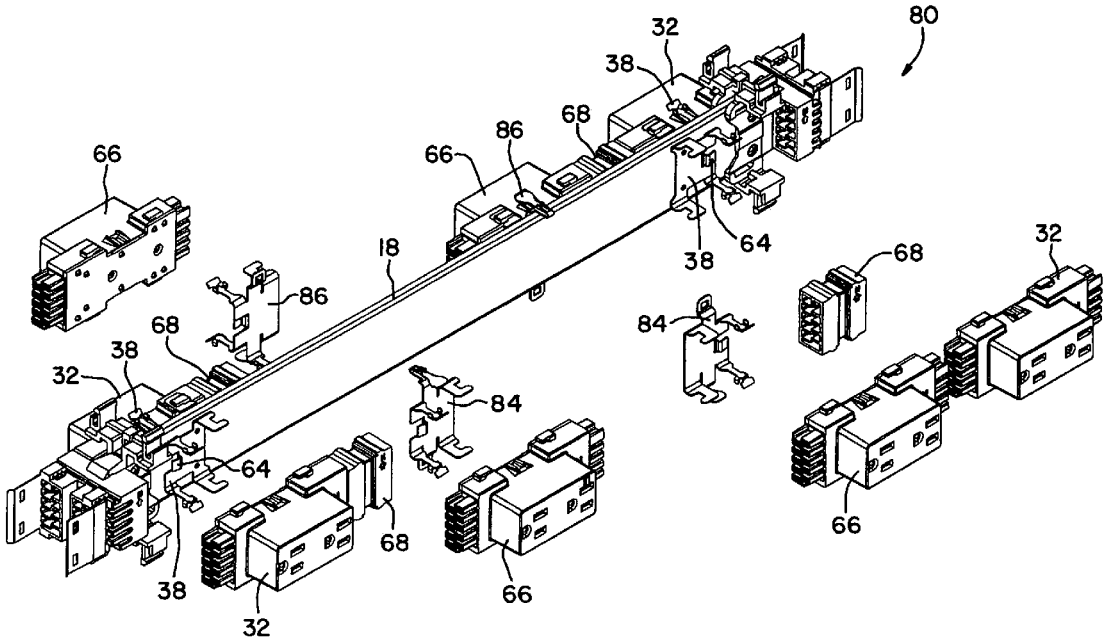
FIG. 6 is a perspective exploded view of another embodiment of an electrical distribution assembly according to the present invention.
Figure 7:
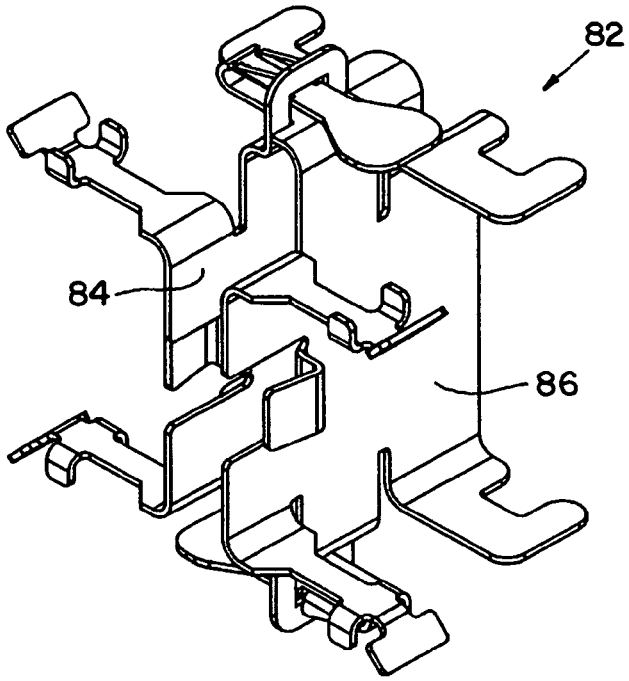
FIG. 7 is a perspective view of the add-on bracket assembly of FIG. 6.
Figure 9:
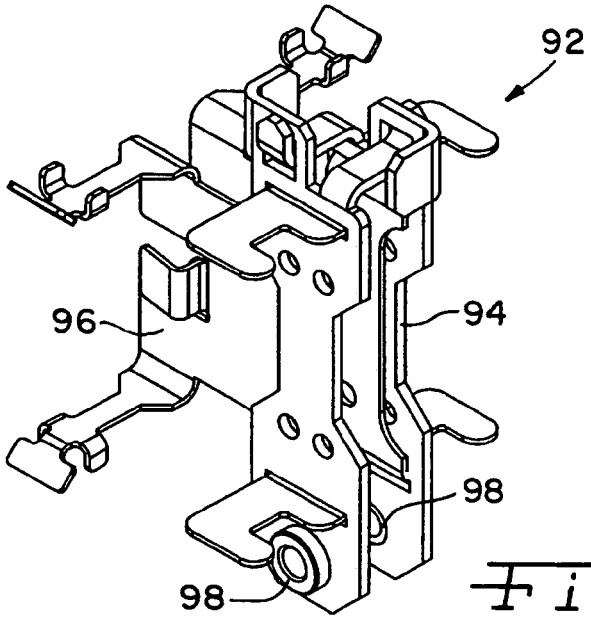
FIG. 9 is a perspective view of the add-on bracket assembly of FIG. 8.
Figure 8:
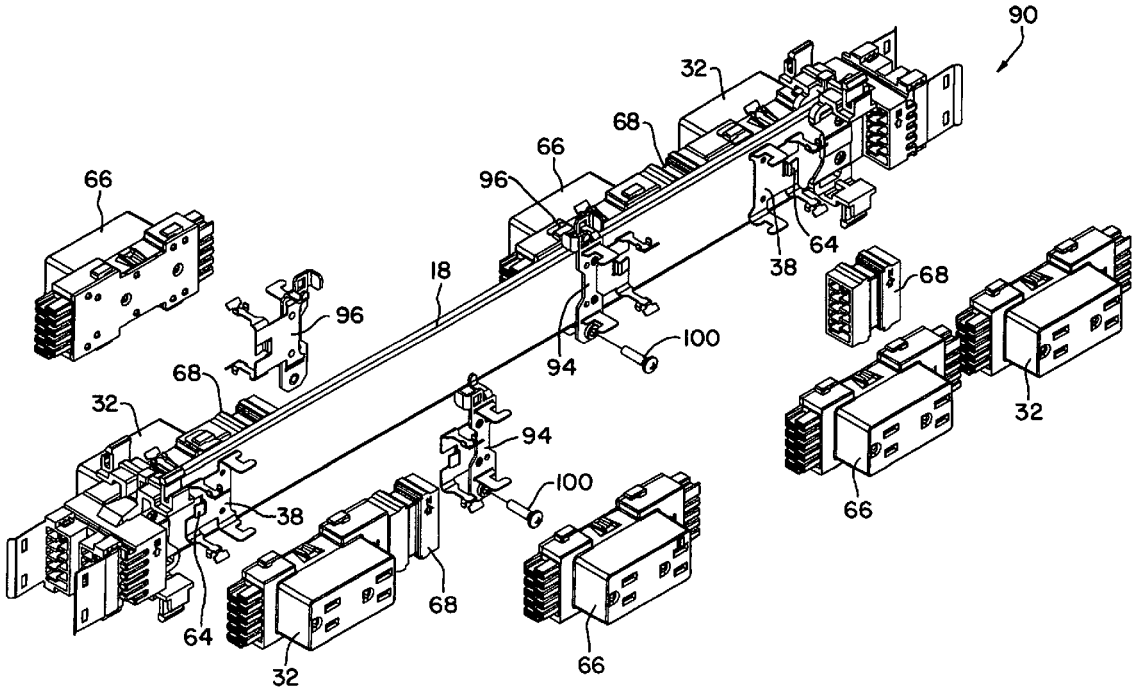
FIG. 8 is a perspective exploded view of another embodiment of an electrical distribution assembly according to the present invention.

FIG. 6 illustrates an embodiment of electrical distribution assembly 80, which is similar to electrical distribution assembly 14, but differs primarily in that electrical distribution assembly 80 includes bracket assembly 82 (FIG. 7) having first bracket 84 and second bracket 86. FIG. 8 illustrates an embodiment of electrical distribution assembly 90, which is similar to electrical distribution assemblies 14 and 80, but differs primarily in that electrical distribution assembly 90 includes bracket assembly 92 (FIG. 9) having first bracket 94 and second bracket 96. Each of brackets 94, 96 can include threaded hole 98 through which screw or fastener 100 can be inserted to clamp bracket assembly 92 to conductor carrier 20.

In use, the present invention provides method of adding an add-on modular receptacle 66 to an electrical distribution assembly 14 for use in a modular wall panel assembly 10, including the steps of: providing electrical distribution assembly 14 having electrical harness 18 having a conductor carrier 20 with first carrier side 22, second carrier side 24 and a plurality of conductors 26 therein, a connector 28 electrically connected to conductors 26 and conductor carrier 20, and a modular receptacle 32 connected to electrical connector port 30 of connector 28; positioning first bracket 46 on first carrier side 22; positioning second bracket 48 on second carrier side 24; directly connecting first bracket 46 to second bracket 48; and mechanically mounting add-on modular receptacle 66 to first bracket 46 or second bracket 48. The method of the present invention can further include the steps of electrically connecting electrical coupler 68 to modular receptacle 32 and add-on modular receptacle 66; providing fixed modular receptacle bracket 38 connected to modular receptacle 32 and to first carrier side 22 or second carrier side 24; directly connecting first bracket 46 and/or second bracket 48 to fixed modular receptacle bracket 38; restricting a movement of first bracket 46 and/or second bracket 48 in a longitudinal direction 72 of conductor carrier 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical distribution assembly for use in a modular wall panel assembly, comprising:

an electrical harness including a conductor carrier with a first carrier side, a second carrier side and a plurality of conductors therein, a connector electrically connected to said plurality of conductors and said conductor carrier, said connector including an electrical connector port, and a modular receptacle connected to said electrical connector port;

a first bracket positioned on said first carrier side;

a second bracket positioned on said second carrier side and directly connected to said first bracket; and an add-on modular receptacle mechanically connected to one of said first bracket and said second bracket.

2. The electrical distribution assembly of claim 1, further including an electrical coupler electrically connected to said modular receptacle and said add-on modular receptacle.

3. The electrical distribution assembly of claim 1, further including a fixed modular receptacle bracket connected to said modular receptacle and to one of said first carrier side and said second carrier side, wherein at least one of said first bracket and said second bracket is directly connected to said fixed modular receptacle bracket.

4. The electrical distribution assembly of claim 3, wherein said fixed modular receptacle bracket includes a tab extending outward from said conductor carrier, at least one of said first bracket and said second bracket includes a tongue which is inserted between said tab and said conductor carrier.

5. The electrical distribution assembly of claim 3, wherein said fixed modular receptacle bracket restricts movement of at least one of said first bracket and said second bracket in a longitudinal direction of said conductor carrier.

6. The electrical distribution assembly of claim 1, further including at least one fastener connected to both said first bracket and said second bracket and clamping both said first bracket and said second bracket to said conductor carrier.

7. A modular wall panel assembly, comprising:

a modular wall panel;

an electrical distribution assembly connected to said modular wall panel, said electrical distribution assembly including:

an electrical harness having a conductor carrier with a first carrier side, a second carrier side and a plurality of conductors therein, a connector electrically connected to said plurality of conductors and said conductor carrier, said connector including an electrical connector port, and a modular receptacle connected to said electrical connector port;

a first bracket positioned on said first carrier side;

a second bracket positioned on said second carrier side and directly connected to said first bracket; and an add-on modular receptacle mechanically connected to one of said first bracket and said second bracket.

8. The modular wall panel assembly of claim 7, further including an electrical coupler electrically connected to said modular receptacle and said add-on modular receptacle.

9. The modular wall panel assembly of claim 7, further including a fixed modular receptacle bracket connected to said modular receptacle and to one of said first carrier side and said second carrier side, wherein at least one of said first bracket and said second bracket is directly connected to said fixed modular receptacle bracket.

10. The modular wall panel assembly of claim 9, wherein said fixed modular receptacle bracket includes a tab extending outward from said conductor carrier, at least one of said first bracket and said second bracket includes a tongue which is inserted between said tab and said conductor carrier.

11. The modular wall panel assembly of claim 9, wherein said fixed modular receptacle bracket restricts movement of at least one of said first bracket and said second bracket in a longitudinal direction of said conductor carrier.

12. The modular wall panel assembly of claim 7, further including at least one fastener connected to both said first bracket and said second bracket and clamping both said first bracket and said second bracket to said conductor carrier.

13. A bracket assembly for adding an add-on modular receptacle to an electrical distribution assembly for use in a modular wall panel assembly, said electrical distribution assembly including a conductor carrier with a first carrier side, a second carrier side, and a fixed modular receptacle bracket connected to one of said first carrier side and said second carrier side, said bracket assembly comprising:

a first bracket configured for positioning on said first carrier side; and a second bracket configured for positioning on said second carrier side and directly connected to said first bracket.

14. The bracket assembly of claim 13, wherein one of said first bracket and said second bracket is configured for directly connecting to the fixed modular receptacle bracket.

15. The bracket assembly of claim 14, wherein the fixed modular receptacle bracket includes a tab extending outward from the conductor carrier, at least one of said first bracket and said second bracket includes a tongue configured for insertion between the tab and the conductor carrier.

16. A method of adding an add-on modular receptacle to an electrical distribution assembly for use in a modular wall panel assembly, comprising the steps of:

providing said electrical distribution assembly including an electrical harness having a conductor carrier with a first carrier side, a second carrier side and a plurality of conductors therein, a connector electrically connected to said plurality of conductors and said conductor carrier, said connector including an electrical connector port, and a modular receptacle connected to said electrical connector port;

positioning a first bracket on said first carrier side;

positioning a second bracket on said second carrier side;

directly connecting said first bracket to said second bracket; and mechanically mounting an add-on modular receptacle to one of said first bracket and said second bracket.

17. The method of claim 16, further including the step of electrically connecting an electrical coupler to said modular receptacle and said add-on modular receptacle.

18. The method of claim 16, further including the step of providing a fixed modular receptacle bracket connected to said modular receptacle and to one of said first carrier side and said second carrier side.

19. The method of claim 18, further including the step of directly connecting one of said first bracket and said second bracket to said fixed modular receptacle bracket.

20. The method of claim 19, further including the step of restricting a movement of at least one of said first bracket and said second bracket in a longitudinal direction of said conductor carrier.

* * * * *